United States Patent [19]

Ono

[11] Patent Number: 4,817,736

[45] Date of Patent: Apr. 4, 1989

[54] PHEUMATIC IMPACT IMPARTING TOOL

[75] Inventor: Akira Ono, Hatoyama, Japan

[73] Assignee: Ritt Corporation, Japan

[21] Appl. No.: 85,723

[22] Filed: Aug. 17, 1987

[30] Foreign Application Priority Data

Aug. 18, 1986 [JP] Japan ..... 61-191697

[51] Int. Cl.[4] ..... B25D 15/00

[52] U.S. Cl. ..... 173/93; 173/935; 92/130.5

[58] Field of Search ..... 192/30.5; 173/12, 93, 173/93.5, 93.6, 122, 123, 124

[56] References Cited

U.S. PATENT DOCUMENTS 2,556,163 6/1951 Beesow et al. ..... 173/123
3,018,674 1/1962 Kohler ..... 173/123
3,174,597 3/1965 Schaedler et al. ..... 192/30.5

*Primary Examiner*—E. R. Kazenske
*Assistant Examiner*—William J. Fridie
*Attorney, Agent, or Firm*—Lorusso & Loud

[57] ABSTRACT

An improved pneumatic impact imparting tool includes a follower which is slidably accommodated in a recess formed on the inner end part of a rotor in a pneumatic motor. The follower is formed with a projection for allowing a ball to come in contact with a cam face as it is rotated together with the rotor. When the ball reaches the top of the cam face, the follower is displaced in the axial direction and enters a recess formed on the inner end part of an anvil to collide against stoppers in the recess. Thus, rotational movement of the rotor is transmitted to the anvil in the form of intermittent turning movement of the latter.

6 Claims, 6 Drawing Sheets

PHEUMATIC IMPACT IMPARTING TOOL

BACKGROUND OF THE INVENTION

1. Field of the Invention

The present invention is concerned with improvement in or relating to a pneumatic impact imparting tool and more particularly to a pneumatic impact imparting tool which is so constructed that a mechanism for converting rotational movement of a pneumatic motor at a constant rotional speed into intermittent turning movement of an anvil is made integral with the motor.

2. Description of the Prior Art

To facilitate understanding of the present invention a typical conventional pneumatic impact imparting tool as disclosed in U.S. Pat. No. 3,174,597 will first be described with reference to FIGS. 4 to 7. Basically, the conventional pneumatic impact imparting tool is constituted by a combination of a pneumatic motor adapted to be rotated by compressed air, a mechanism for converting rotational movement of the pneumatic motor into intermittent turning movement of an anvil. Incidentally, FIG. 4 is a vertical sectional view of the conventional pneumatic impact imparting tool.

As is apparent from FIG. 4, rotational force transmitting means comprises mainly a pneumatic motor 10 and a hammer 12. Specifically, the pneumatic motor 10 includes a column-shaped rotor 14 having a shaft 13 extended therethrough, a cylinder 16 surrounding the rotor 14, a rear plate 18 secured to the lower side of the cylinder 16 and a front plate 20 secured to the upper side of the same to airtightly close the cylinder 16, as shown in FIG. 5 which is a perspective view of the main components of the pneumatic motor in the disassembled state. To assure that the shaft 13 for the rotor is held rotatably, both the rear plate 18 and the front plate 20 are fitted with bearings 22 and 23. The rotor 14 is formed with a plurality of radially extending grooves 24 in an equally spaced relationship each of the grooves 24 extends from the exterior surface of the rotor 14 inwardly in parallel with the shaft. Further, a vane 26 is inserted in each of the grooves 24 in such a manner that it slides in the radial direction relative to the shaft 13. The shaft 13 of the rotor 14 projects through the front plate 20 and the part of the shaft 13 projected outwardly of the front plate 20 is formed with a plurality of spline teeth 28. Importantly, the inner space of the cylinder is so designed that the center axis of the hollow space is located offset from the center axis of the outer wall of the cylinder 16. Owing to the eccentric construction of the pneumatic motor 10 in that way, the rotor 14 is rotated by means of the vanes 26 as compressed air is introduced into the hollow space between the cylinder 16 and the rotor 14 by utilizing known means.

On the other hand, the hammer 12 includes an anvil 34 adapted to be intermittently turned by rotation of the motor 10 and means for converting rotation of the motor 10 into intermittent turning movement of the anvil 34. Further, the hammer 12 includes a cylinderical cage 36 of which the lower end is closed. The closed end of the cage 36 is formed with a plurality of spline grooves adapted to come in engagement with the spline teeth 28 on the shaft 13 of the rotor 14. Since the cage 36 is made integral with the rotor 14 via spline engagement, it is caused to rotate at the same rotational speed as that of the rotor 14. The anvil 34 is formed with a plurality of spline teeth 38 at its lower end as seen in the drawing. As is best seen in FIG. 7, wings 40 extending in the leftward and rightward directions are made integral with the anvil 34. Both the spline teeth 38 and the wings 40 are accommodated in the interior of the cage 36. A spindle guide 42 against which the lowermost end of the anvil 34 abuts is fixedly secured to the cage 36 so that an annular groove is formed between the outer surface of the spindle guide 42 and the inner wall of the cage 36. A ball 44 is disposed at a predetermined position on the annular groove (at a predetermined position where it turns together with the cage 36).

A cam member 46 as shown in FIGS. 6 and 7 is designed in a cylindrical configuration and a plurality of spline grooves adapted to come in engagement with the spline teeth 38 on the anvil 34 are formed over the cylindrical inner wall of the cam member 46. The cam member 46 is adapted to slide in the axial direction of the anvil 34 while maintaining engagement with the spline teeth 38 of the anvil 34. The lower end part of the cam member 46 constitutes cam face 48 with which the ball 44 is brought in contact. The cam face 48 exhibits a hill-shaped contour as seen from the side. Further, an outwardly projecting annular boss portion 50 is made integral with the cam member 46 around the outer surface thereof. As shown in FIG. 8, the cage 36 is formed with two semicylindrical grooves 53 through which pins 52 are inserted for sliding in the axial direction. Each of the pins 52 is formed with an annular recess 54 which comes into engagement with the annular boss portion 50 of the cam member 46. Accordingly, the pins 52 are caused to slide along the grooves 53 on the cage 36 as the cam member 46 is slidably displaced up and down. Further, a spring 56 is disposed in the hollow space between the surface of the cam member 46 located opposite to the cam face 48 and the wings 40 whereby the cam member 46 is normally urged toward the motor 10 under the effect of the resilient force of the spring 56. A cover 58 is tightly fitted into the opening portion of the cage 36 in order to inhibit the cage 36 and the anvil 34 from being displaced in the transverse direction relative to one another.

Next, description will be made below as to how rotational movement of the rotor 14 at a constant rotational speed is converted into intermittently turning movement of the anvil 34. As the rotor 14 is rotated, the cage 36 is caused to rotate and the ball 44 accommodated at the predetermined position in the cage 36 turns together with the cage 36. When the ball 44 comes in contact with an incline the cam face 48, the cam member 46 is slidably displaced toward the wings 40 by means of the ball 44 against resilient force of the spring 56. As the cam member 46 is slidably displaced in that way, a pair of pins 52 are also slidably displaced toward the wings 40 together with the cam member 46. As a result, the upper part of each of the pins 52 is projected upwardly in the area located by the side of the wing 40. When the cage 36 (pin 52) is rotated further in such a state that the upper parts of the pins 52 are projected upwardly, the pins 52 are brought into abutment against the wings 40, causing the anvil 34 to be turned (see FIG. 7). Thereafter, the ball 44 moves over the hill top of the cam face 48 and thereby the cam member 46 is slidably displaced downwardly to its original position under the effect of resilient force of the spring 56. At the same time the pair of pins 52 are displaced downwardly to the original position where they no longer contact the wings 40.

The cam member 46 does not carry out sliding movement any longer until the ball 44 contacts the inclined part of the cam face 48 after it moves over the hill top of the same. Then, the same operation as mentioned above is repeated when the ball 44 comes in contact with the inclined part of the cam face 48.

As will be apparent from the above description, the motor 10 is made separate from means for converting rotational movement of the motor 10 into intermittent turning movement of the anvil 34. This leads to a drawback that the overall length of the conventional pneumatic impact imparting tool is elongated.

SUMMARY OF THE INVENTION

The present invention has been made with the foregoing background in mind and its object resides in providing a pneumatic impact imparting tool which is so constructed that a motor is made integral with means for converting rotational movement of the motor into intermittent turning movement of an anvil for the purpose of reducing the overall length of the pneumatic impact imparting tool.

To accomplish the above object there is provided according to the present invention a pneumatic impact imparting tool comprising a rotor in a pneumatic motor adapted to be rotated by compressed air, a ball adapted to carry out planetary movement as the rotor is rotated, a recess formed on the inner end part of the rotor as seen in the axial direction of the rotor, a follower accommodated in the recess to slide in the axial direction, the follower being rotated together with the rotor, an anvil adapted to be intermittently turned under the effect of impact imparted by the follower, a recess formed on the inner end part of the anvil as seen in the axial direction of the anvil so that the follower is displaced into the recess when it impacts the anvil, a cam member for displacing the follower in the axial direction of the rotor in operative association with the ball when the follower imparts impact to the anvil, the cam member being operatively connected to the anvil, and urging means for normally urging the follower toward the rotor.

A recess is formed on the inner end part of the rotor and an assembly comprising follower serving as means for converting rotational movement of the rotor into intermittently turning movement of the anvil, ball and cam member is accommodated in the recess. The follower is adapted to rotate together with the rotor. The follower is formed with a projection for allowing the ball to carry out planetary movement as it is rotated. When the ball reaches the top of the hill portion of the cam member, the follower is displaced toward the anvil and enters a recess formed on the inner end part of the anvil to collide against stoppers in the recess on the anvil at a time when the follower is rotated further by a predetermined angle. Collision of the follower against the stoppers causes both the anvil and the cam member to be turned. After collision of the follower against the stoppers takes place, the ball moves over the top of the hill portion of the cam member. Thereafter, the follower comes back toward the original position away from the anvil under the effect of resilient force of a spring.

Other objects, features and advantages of the present invention will become readily apparent from reading of the following description which has been prepared in conjunction with the accompanying drawings

BRIEF DESCRIPTION OF THE DRAWINGS

The present invention will be illustrated in the following drawings in which.

DESCRIPTION OF THE PREFERRED EMBODIMENT

Figure 2:
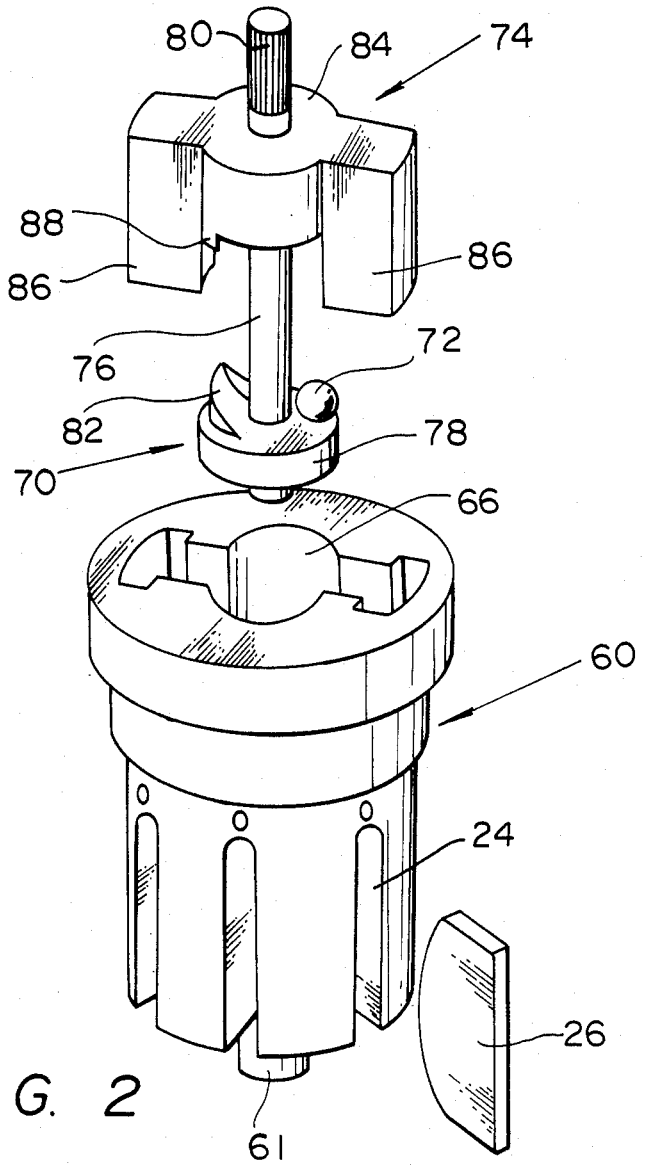
FIG. 2 is a perspective view illustrating means for converting rotational movement of a rotor into intermittent turning movement of an anvil as well as the rotor in the disassembled state.
Figure 3:
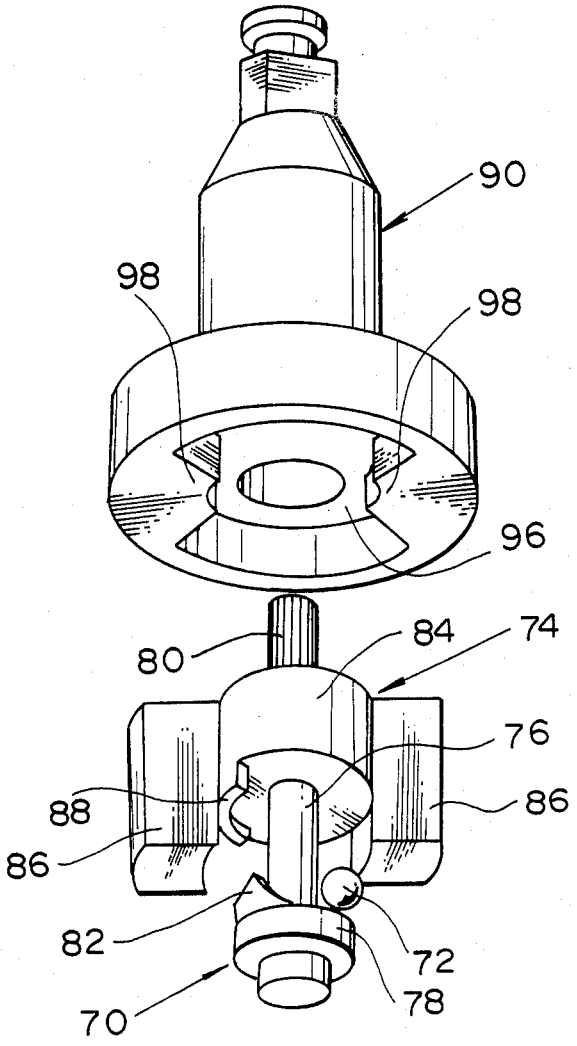
FIG. 3 is a perspective view illustrating an anvil and the aforesaid means for converting rotational movement of the rotor into intermittent turning movement of the anvil in the disassembled state.
Figure 4:
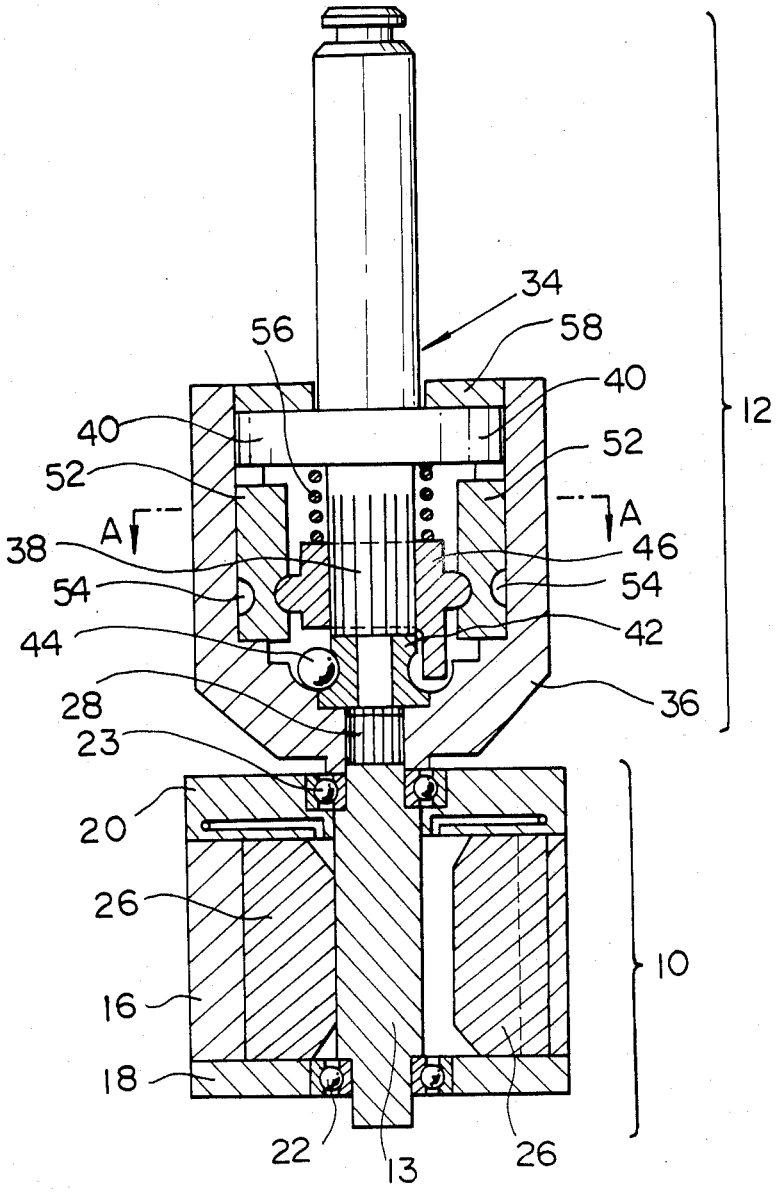
FIG. 4 (PRIOR ART)
FIG. 4 is a vertical sectional view of a conventional pneumatic impact imparting tool.
Figure 5:
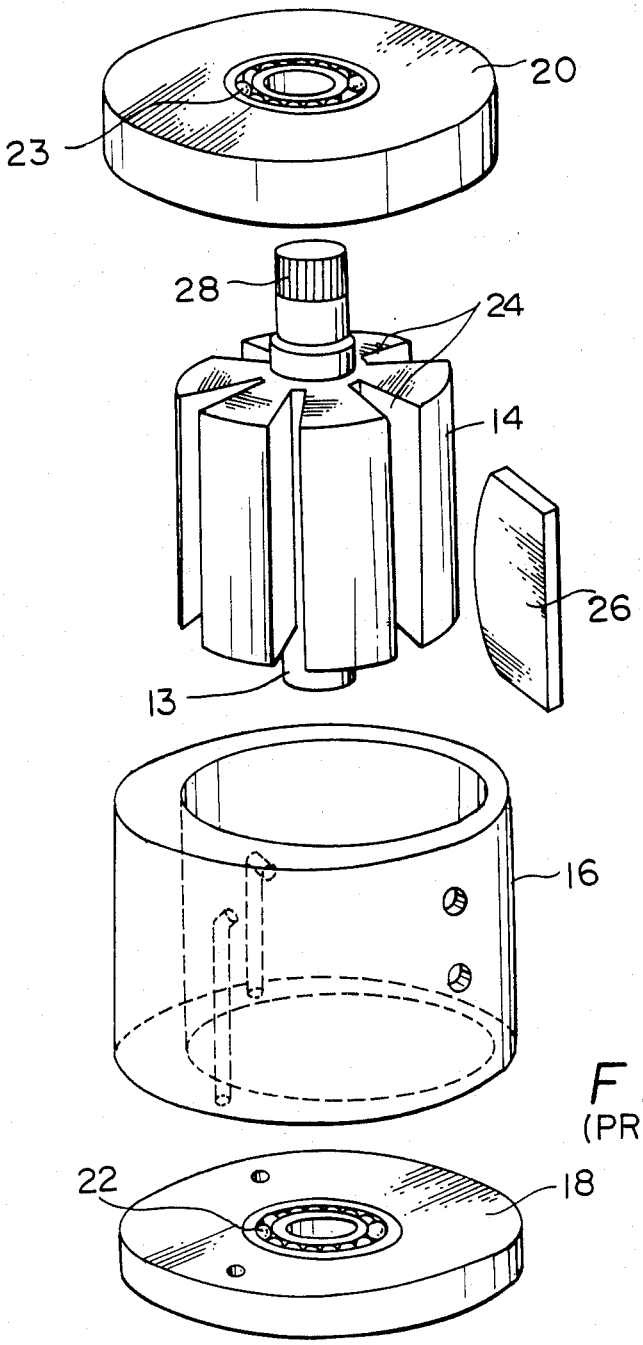
FIG. 5 (PRIOR ART)
FIG. 5 is a perspective view of a conventional rotor in a pneumatic motor shown in the disassembled state.
Figure 6:
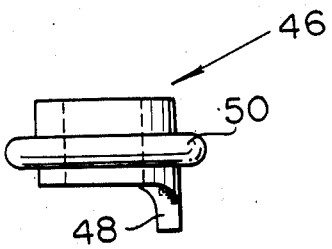
FIG. 6 (PRIOR ART)
FIG. 6 is a side view of the cam member shown in FIG. 4.
Figure 7:
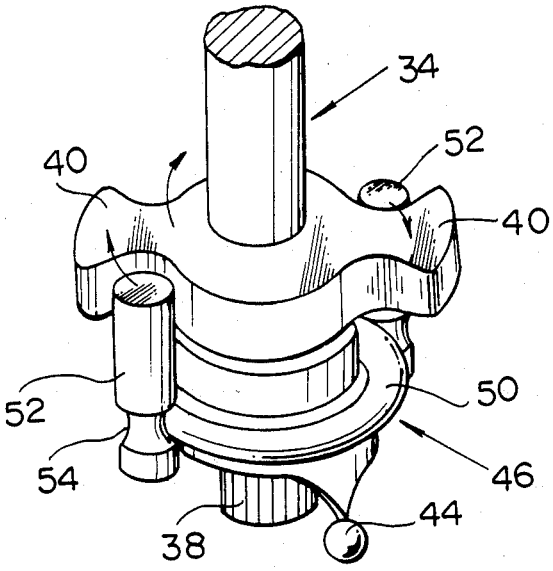
FIG. 7 (PRIOR ART)
FIG. 7 is a perspective view illustrating the relationship among the anvil, the cam member and the pins in FIG. 4.
Figure 8:
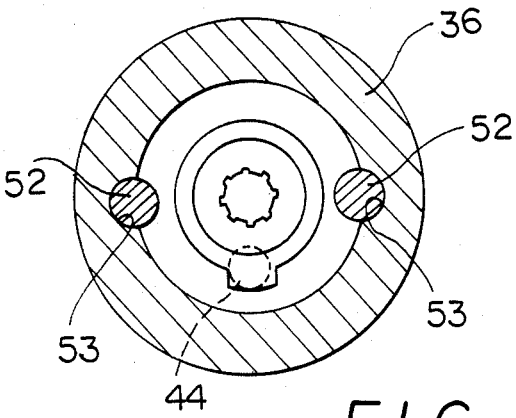
FIG. 8 (PRIOR ART)
FIG. 8 is a cross-sectional view of the cage and the pins taken in along line A—A in FIG. 4.

Now, the present invention will be described in greater detail hereunder with reference to FIGS. 1 to 3.

Figure 1:
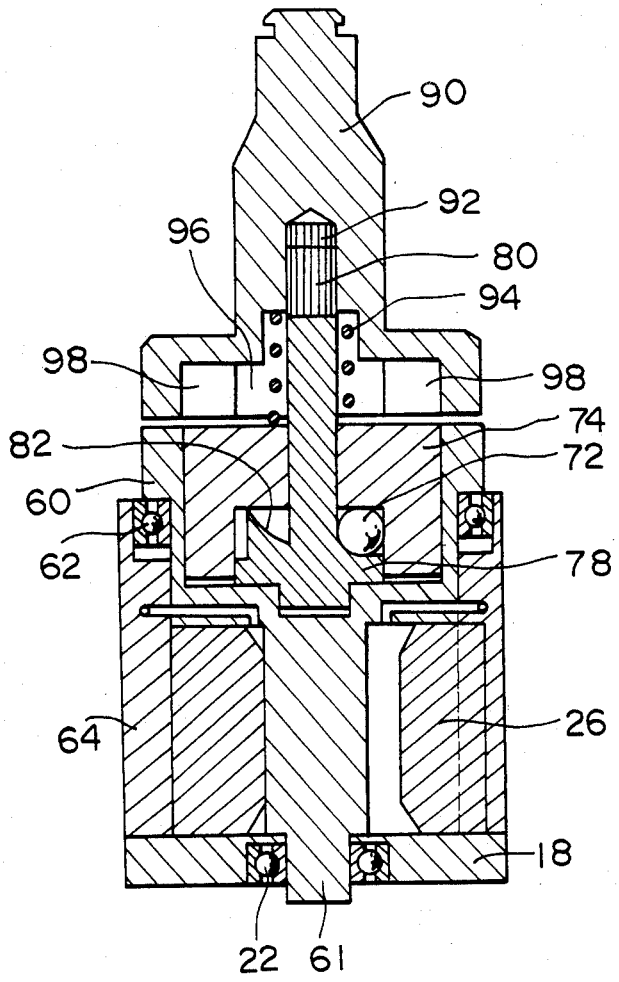
FIG. 1 is a vertical sectional view of a pneumatic impact imparting tool in accordance with an embodiment of the invention, illustrating the main components constituting the tool.

FIG. 1 is a vertical sectional view of main components of a pneumatic impact imparting tool in accordance with an embodiment of the invention. FIG. 2 is a perspective view of a rotor as well as means for converting rotational movement of the rotor into intermittent turning movement of an anvil, both of which are shown in a disassembled state. FIG. 3 is a perspective view of the aforesaid means and the anvil, both of which are shown in a disassembled state. It should be noted parts or components in FIGS. 1 to 3 which are the same or similar as those shown in FIGS. 4 to 7 are identified by the same reference numerals.

A column-shaped rotor 60 has a shaft 61 projected from the lower end thereof and is formed with a plurality of grooves 24 in the area as defined between the lower end and the middle part of the rotor 60. As is apparent from FIG. 2, the grooves 24 extend in parallel with the axis of the rotor 60 and a vane 26 is inserted into each of the grooves 24 to slidably move in the radial direction. The rotor 60 is rotatably accommodated in the interior of a cylinder 64 with the aid of a bearing 62 and the shaft 61 of the rotor 60 extends through a rear plate 18 to be rotatably held thereby. The inner space of the cylinder 64 is so designed that the center axis of the inner space is offset from the center axis of the outer wall of the cylinder 64. Compressed air is introduced into the inner space of the cylinder 64 by employing a known method so that the rotor 60 is rotated by the thus introduced compressed air.

The rotor 60 has a recess 66 formed on the upper side thereof located opposite to the shaft 61 and the recess 66 has a considerable depth. As shown in FIGS. 2 and 3, a cam member 70, a ball 72 and a follower 74 are accommodated in the recess 66. The cross-sectional shape of the recess 66 is so designed that the follower 74 is snugly accommodated in the interior of the recess 66.

The cam member 70 comprises a rod 76 and a disc-shaped cam 78 located at the lower end thereof both of which are made integral with one another and the upper end part of the cam member 70 is formed with a plurality of spline teeth 80. The cam 78 has a hill portion 82 projecting upwardly of the upper surface thereof and a ball 72 is disposed on the upper surface of the disc of the cam 78 in the same manner as the hill portion 82. Next, the follower 74 comprises a column-shaped portion 84 and a pair of wings 86 located on both the sides thereof both of which are made integral with one another. The height of each of the wings 86 is greater than that of the column-shaped portion 84. The distance between the pair of wings 86 is so determined that the disc-shaped cam 78 is accommodated in the hollow space as defined between both the wings 86. The column-shaped portion 84 is integrally formed with a projection 88 on the lower side thereof which is adapted to come in engagement with the ball 72. Thus, the ball 72 is turnably displaced as the follower 74 is rotated together with the projection 88. Further, a hole through which the rod 76 of the cam member 70 extends slidably is formed at the central part of the column-shaped portion 84.

As shown in FIG. 1, the cam member 70, the ball 72 and the follower 74 are accommodated in the recess 66 of the rotor 60. At this moment the ball 72 is placed on the disc of the cam 78 of the cam member, the rod 76 of the cam member 70 is inserted through the follower 74 and the ball 72 is held between the disc of the cam 78 and the follower 74 (see FIG. 2). While the above-mentioned three components are accommodated in the recess 66 of the rotor 60, the spline teeth 80 at the upper end of the rod 76 are located outside of the recess 66 of the rotor 60.

An anvil 90 is formed with a bore having a plurality of spline grooves 92 for mating with the spline teeth 80 of the cam member 70. Accordingly, the cam member 70 and the anvil 90 are rotated together. As shown in FIG. 1, a spring 94 is interposed between the lower end face of the anvil 90 and the upper face of the follower 74 so that the follower 74 is normally urged away from the anvil 90 under the effect of the resilient force of the spring 94. Namely, the follower 74 is thrusted into the interior of the recess 66 of the rotor 60 with the aid of the spring 94 whereby the ball 72 is held between the follower 74 and the cam 78 of the cam member 70, as shown in FIG. 1. The anvil 90 is formed with a recess 96 on the lower side thereof located opposite to the follower 74 for the purpose of receiving the one end of the spring 94 and the recess 96 of the anvil 90 includes two stoppers 98 which project downwardly toward the follower 74.

Next, operation of the pneumatic impact imparting tool of the invention as constructed in the above-described manner will be described below.

As compressed air is introduced into the interior of the cylinder 64, the rotor 60 is rotated in the same manner as the conventional pneumatic impact imparting tool. Then, as the rotor 60 is rotated in that way, the follower 74 fitted into the recess 66 of the rotor 60 is also rotated together with the rotor 60. At this moment the rod 76 of the cam member 70 which extends through the central part of the follower 74 is not rotated together with the rotor 60, because its upper end is fitted into the anvil 90. During rotation of the follower 74 caused by the rotor 60 the projection 88 on the follower 74 abuts against the ball 72 whereby the latter is slidably displaced around the rod 76 of the cam member 70 to carry out planetary movement about the shaft 76. As the ball 72 climbs the hill portion 82 of the cam 78, the follower 74 is displaced toward the anvil 90 by means of the ball 72 against resilient force of the spring 94. Namely, the follower 74 is caused to slide in the recess 66 of the rotor 60 toward the anvil 90 with the result that the upper part of the follower 74 is introduced into the recess 96 of the anvil 90.

Due to the fact that the follower 74 is rotated together with the rotor 60, the upper part of the follower 74 which has been introduced into the recess 96 of the anvil 90 collides against the stoppers 98 on the anvil 90. Then, the anvil 90 is turned under the effect of collision of the follower 74 against the stoppers 98. Since arrangement is so made that the ball 72 moves over the hill portion 82 at a time a little bit before when the above-mentioned collision takes place, the follower 74 begins to move back toward the original position in the recess 66 under the effect of resilient force of the spring 94 immediately after the follower 74 collides against the stoppers 98. As long as the follower 74 is retained in the interior of the recess 66, the anvil 90 is not turned any longer. When the ball 72 climbs the hill portion 82 later again, the same operation as mentioned above is repeated to turn the anvil 90 intermittently.

As will be apparent from the above description, the pneumatic impact imparting tool of the invention is constructed in such a manner that a recess is formed on one end part of the rotor and means for converting rotational movement of the rotor into intermittent turning movement of the anvil is accommodated in the thus formed recess. On the other hand, the conventional pneumatic impact imparting tool including a pneumatic motor and means for converting rotational movement of the motor into intermittent turning movement of the anvil both of which are arranged separately requires that the rotor be airtightly encased by a combination of cylindrical member, rear plate and front plate in order to prevent leakage of compressed air which is used for rotating the rotor. Further, there is a need for provision of a cage in which means for converting rotational movement of the rotor into intermittent turning movement of the anvil is accommodated.

In contrast with the conventional pneumatic impact imparting tool, the pneumatic impact imparting tool of the invention is so constructed that means for converting rotational movement of the rotor into intermittent turning movement of the anvil is accommodated in a recess which is formed on one end of the rotor. Thus, there is no need for any front plate and moreover there is no need for the wall portion of the cage. As a result, a thickness corresponding to the front plate and the wall portion of the cage is not required and therefore the whole length of the pneumatic impact imparting tool as measured in the axial direction can be reduced remarkably. Further, there is no need for the cage in which means for converting rotational movement of the rotor into intermittent turning movement of the anvil is accommodated. Thus, the number of components constituting the pneumatic impact imparting tool can be reduced and thereby it can be manufactured at an inexpensive cost.

While the present invention has been described above with respect to a single preferred embodiment, it should of cource be understood that it should not be limited only to it but various changes or modifications may be made in a suitable manner without any departure from the spirit and scope of the invention as defined by the appended claims.

What is claimed is:

1. A pneumatic impacting tool comprising:

a pneumatic motor including a cylindrical rotor, said rotor being adapted to be rotated by compressed gas and having an axially extending rotor recess in one end face;

a shaft aligned with the axis of rotation of said rotor and having one end rotatably mounted within said recess in said rotor;

an anvil having an axially extending anvil recess for receiving the end of said shaft opposite said one end and having, within said anvil recess, (1) shaft receiving means for holding said shaft against rotation relative to said anvil and (2) radially extending impact receiving means;

a follower slidably seated within said rotor recess for rotation therewith and mounted on said shaft for reciprocating sliding movement between an anvil disengaged position where said follower is engaged within said rotor recess for rotation with said rotor while said anvil is not rotated and an anvil engaged position where said follower is engaged within both said rotor recess and said anvil recess whereby said anvil is rotated with said rotor;

biasing means for biasing said follower toward said anvil disengaged position;

camming means, within said rotor recess, for intermittently driving said follower into said anvil recess against the force of said biasing means, said follower striking said impact receiving means by rotation within said anvil recess, thereby generating impacting force.

2. A pneumatic impacting tool in accordance with claim 1 wherein said opposite end of said shaft is splined and wherein said shaft receiving means is an axial bore which opens into said anvil recess and which is splined for engagement with said splines on said shaft.

3. A pneumatic impacting tool in accordance with claim 2 wherein said camming means comprises:

a camming member mounted on said shaft for rotation therewith and presenting a camming surface facing said follower;

a ball member mounted between said follower and said camming surface;

means on said follower for moving said ball member along a generally circular path on said camming surface thereby, in cooperation with said biasing means, imparting said reciprocating sliding movement to said follower.

4. A pneumatic impacting tool in accordance with claim 2 wherein said biasing means is a spring mounted in said anvil recess.

5. A pneumatic impacting tool in accordance with claim 3 wherein said camming surface has a projection rising to a peak and wherein said follower strikes said impact receiving means when said ball member reaches said peak.

6. A pneumatic impacting tool in accordance with claim 1 wherein said follower has at least one radially extending projection and wherein said rotor recess and said anvil recess are shaped to mate with said projection.

* * * * *